US006260469B1

(12) United States Patent
Ahn

(10) Patent No.: US 6,260,469 B1
(45) Date of Patent: Jul. 17, 2001

(54) PISTON FOR USE IN A COMPRESSOR

(75) Inventor: Hewnam Ahn, MooGungHwa KyongNam (KR)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/366,307

(22) Filed: May 2, 1999

(30) Foreign Application Priority Data

Oct. 11, 1998 (KR) ..... 98-048041

(51) Int. Cl.[7] ..... F01B 3/00
(52) U.S. Cl. ..... 92/71; 92/172
(58) Field of Search ..... 92/70, 71, 172, 92/175

(56) References Cited

U.S. PATENT DOCUMENTS 1,006,269 * 10/1911 Phifer ..... 92/71
5,201,261 * 4/1993 Kayukawa et al. ..... 92/71
5,616,008 * 4/1997 Yokono et al. ..... 417/222.2

* cited by examiner

*Primary Examiner*—Edward K. Look
*Assistant Examiner*—Thomas E. Lazo
(74) *Attorney, Agent, or Firm*—Brinks Hofer Gilson & Lione

(57) ABSTRACT

A piston, adapted for use in a swash plate type of air conditioning compressor including a generally cylindrical cylinder block provided with at least one cylinder bore, in which the piston is reciprocally disposed. The piston includes a cylindrical body with a head portion, a bridge portion extending from the body and having a recess, and a pair of shoe pockets formed in opposed walls defined in the recess. Each of the shoe pockets includes an entrance and an apex, and a lower edge portion of the body is positioned at an adjoining portion between the body and the bridge portion extending to a place between the entrance and the apex of the shoe pocket adjacent to the body.

2 Claims, 2 Drawing Sheets

PISTON FOR USE IN A COMPRESSOR

FIELD OF THE INVENTION

The present invention relates to a piston for use in a compressor, and more particularly, to a piston suitable for use in an automotive air conditioning compressor in which there is provided a piston having a construction to minimize a bending moment exerted thereon and a mechanism in response to such piston.

BACKGROUND OF THE INVENTION

Generally, a piston type compressor for use in an automotive air conditioning system comprises a cylinder block having a plurality of cylinder bores. A plurality of pistons are slidably disposed in the respective cylinder bores and reciprocated by, for example, a swash plate or wobble plate in the cylinder bores. In a variable capacity swash plate type compressor with a mechanism varying an inclination angle of the swash plate, a single-headed piston is generally used. The single-headed piston includes a body with a head, and a support portion for receiving shoes which convert rotation of the swash plate into reciprocation of the pistons. However, a bending moment acts on the pistons due to a component of the force that is exerted normal to the direction of motion of the pistons during operation of the compressor. Accordingly, the bending moment causes the deformation of pistons, and thus, a contact portion between the pistons and the cylinder bores is abraded.

In order to clarify the problems occurring in a typical swash plate type compressor with a variable displacement mechanism, description will be made with reference to FIG. 1. The compressor 1 of this type has a cylinder block 2, with a plurality of cylinder bores 4, and with front and rear ends of the cylinder block 2 sealingly closed by front and rear housing portions 6 and 8, respectively. The cylinder block 2 and the front housing 6 define an air-tight sealed crank chamber 10. A valve plate 12 is mounted between the rear end of the cylinder block 2 and the rear housing 8. The rear housing 8 has formed therein inlet and outlet ports 14 and 16 for input and output of a refrigerant gas, a suction chamber 18, and a discharge chamber 20. The suction and discharge chambers 18 and 20 are in communication with the respective cylinder bores 4 via suction and discharge valve mechanisms. A drive shaft 22 is centrally arranged to extend through the front housing 6 to the cylinder block 2 and rotatably supported by bearings mounted in the front housing 6 and the cylinder block 2. The cylinder block 2 and the front and rear housing 6 and 8 are combined by screws 25. A rotor 26 is mounted on the drive shaft 22 in the crank chamber 10 to be rotatable with the drive shaft 22, and is supported by a thrust bearing 28 seated on an inner end of the front housing 6. A spherical sleeve 30, having an outer spherical surface formed as a support surface, is slidably supported by the drive shaft 22. A spring 32, mounted around the drive shaft 22, is interposed between the rotor 26 and the spherical sleeve 30, and biases the spherical sleeve 30 toward the rear housing 8.

A swash plate 34 is rotatably supported on the outer surface of the spherical sleeve 30. The swash plate 34 is connected to the rotor 26 via a hinge mechanism so as to be rotated with the rotor 26. The hinge mechanism includes a support arm 36 that protrudes axially outwardly from one side surface of the rotor 26, and an arm 38 that protrudes from one side surface of the swash plate 34 toward the support arm 36 of the rotor 26. The support arm 36 and the arm 38 overlap each other and are connected to each other by a pin 40. The pin 40 extends into a pin hole 42 formed through the support arm 36 of the rotor 26 and a rectangular shaped hole 43 formed through the arm 38 of the swash plate 34. In this manner, the rotor 26 and the swash plate 34 are hinged to each other, and the sliding motion of the pin 40 within the rectangular hole 43 changes the inclination angle of the swash plate 34 so as to change the capacity of the compressor.

Pistons 44 are slidably disposed in the respective cylinder bores 4. Each piston 44 has a body 46 with a head portion which is slidably disposed in the corresponding cylinder bore 4, and a bridge portion 48 which has formed therein a recess 50. Semi-spherical shoes 52 are disposed in shoe pockets 54 formed in the bridge portion of the piston 44 and slidably engaged with a peripheral portion of the swash plate 34. Therefore, the swash plate 34 is rotated together with the rotation of the drive shaft 22, and the rotation of the swash plate 34 is converted into the reciprocation of the pistons 44.

A cutout portion 56 is formed at a lower front end portion of the piston 44 to prevent contact between a side surface of the swash plate 34 and the body 46 of the piston 44 when the piston is in its bottom dead center position.

A control valve means 60 is provided with the compressor to adjust a pressure level in the crank chamber 10.

In the above-described type of compressor, a bending moment generated from various forces acting on the pistons 44 causes a deformation of the pistons 44 and potentially excessive abrasion about a contact portion between the pistons 44 and their corresponding cylinder bores 4. FIG. 2 illustrates an enlarged partial view of FIG. 1, showing the various forces acting on a piston. During the compression stroke of the piston 44, the pressure $P_c$ in the crank chamber 10 acts on the forward end of the piston 44 while a compression reaction force $P_d$ acts on the other end of the piston 44. The pressure $P_c$ in the crank chamber 10 and the compression reaction force $P_d$ act on the swash plate from the piston via the shoes 52 creating an action force on the swash plate 34, with obviously a reaction force that is equal in magnitude and oppositely directed to the action force. That is, when the piston 44 is in its compression stroke, the force F exerted from the swash plate 34 on the piston 44 acts in a direction that is perpendicular to surfaces of the swash plate 34 at a contact location where the semi-spherical outer surface of the shoe adjacent to the body of the piston 44 comes into contact with the semi-spherical inner surface of the shoe pocket 54. This location is at an apex of the shoe pocket 54 lying on the central axis O of the piston 44. If the force F exerted from the swash plate 34 on the piston 44 is decomposed into two components, a horizontal and a vertical component, there will be a horizontal component $F_x$ lying on the central axis O of the piston 44 and a vertical component $F_y$ being perpendicular to the central axis O of the piston 44. Let "m" be the mass of the piston 44, "a" the acceleration of piston during the compression stroke, and "A" the surface area against which the pressure acts. Thus, $$\Sigma F_x = ma$$

$$\Sigma F_x = AP_c - AP_d + F_x$$

By combining the above equations, we can write, $$F_x = ma + A(P_d - P_c) = ma + (\pi/4)*d^2(P_d - P_c)$$

and $$F_y = F_x \tan\theta = \tan\theta[ma + (\pi/4)*d^2(P_d - P_c)]$$

which d is a diameter of piston.

The vertical component $F_y$, then, will act on the piston 44 to create a bending moment which is maximum at the lower back edge designated by "p". As stated above, the cutout portion 56 is provided to prevent the piston 44 from coming into contact with the rear surface of the swash plate 34 when the piston 44 approaches its bottom dead center position. However, the cutout portion 56 creates a horizontal distance x between the operating point of the force F acting on the piston and the location of the reaction force acting on the cutout portion 56 at p. This distance x creates a bending moment which acts on the piston 44. The maximum bending moment $M_{max}$ acting on the piston is given by $$M_{max}=xF_y=x\tan\theta[ma+(\pi/4)*d^2(P_d-P_c)]$$

Therefore, due to the bending moment, the piston will tend to cock in its cylinder in a counterclockwise direction with respect to the reaction force-operating point P, creating the possibility of abnormally excessive abrasion on the body of the piston about the reaction force-operating point P and in an edge portion diagonally opposed thereto.

SUMMARY OF THE INVENTION

In its embodiments, the present invention contemplates a single headed piston, adapted for use in a swash plate type of air conditioning compressor including a generally cylindrical cylinder block provided with at least one cylinder bore, in which the piston is reciprocally disposed. The piston includes a cylindrical body with a head portion. It also includes a bridge portion extending from the body and having a recess and a pair of shoe pockets formed in opposed walls defined in the recess, with each of the shoe pockets including an entrance and an apex. A lower edge portion of the body is positioned at an adjoining portion between the body and the bridge portion extending to a place between the entrance and the apex of the shoe pocket adjacent to the body.

The present invention further contemplates a variable capacity swash plate type compressor. The compressor includes a housing having a cylinder block with a plurality of cylinder bores formed therein and enclosing a crank chamber, a suction chamber, and a discharge chamber. A drive shaft is rotatably supported by the housing mechanism. A plurality of single headed pistons are reciprocally disposed in each of the cylinder bores, with each of the pistons having a generally cylindrical body with a head portion, a bridge portion extending from the body and having a recess, and a pair of shoe pockets formed in opposed walls defined in the recess, with each of the shoe pockets including an entrance and an apex, and a lower edge portion of the body positioned at an adjoining portion between the body and the bridge portion extending to a place between the entrance and the apex of the shoe pocket adjacent to the body. A rotor is mounted on and rotationally fixed to the drive shaft so as to rotate together with the drive shaft in the crank chamber, and a hinge mechanism operatively engages the rotor. A swash plate is operatively connected to the rotor via the hinge mechanism and is slidably mounted on the drive shaft. The swash plate includes a side generally facing the cylinder block, with a recess in the side extending circumferentially around the side, radially located to be adjacent to an end of the piston heads. The compressor also includes motion conversion means disposed between the swash plate and the pistons for converting nutational motion of the swash plate into reciprocation of the pistons in the respective cylinder bores.

Accordingly, an object of the present invention is to provide a swash plate type compressor with pistons by which the above-mentioned problems can be solved.

Another object of the invention is to provide a swash plate type compressor and, more particularly, a variable capacity swash plate type compressor, provided with a piston having a construction to minimize a bending moment by which high durability of the piston and compressor can be accomplished.

Still another object of the invention is to provide a swash plate type compressor provided with a mechanism suitable for a piston having a construction to minimize a bending moment.

An advantage of the present invention is that the possibility of abnormally excessive abrasion is substantially reduced.

Other objects, features, and advantages of the present invention will be understood from the detailed description of the preferred embodiments of the present invention with reference to the accompanying drawings.

DETAILED DESCRIPTION OF THE PREFERRED EMBODIMENTS

Figure 3:
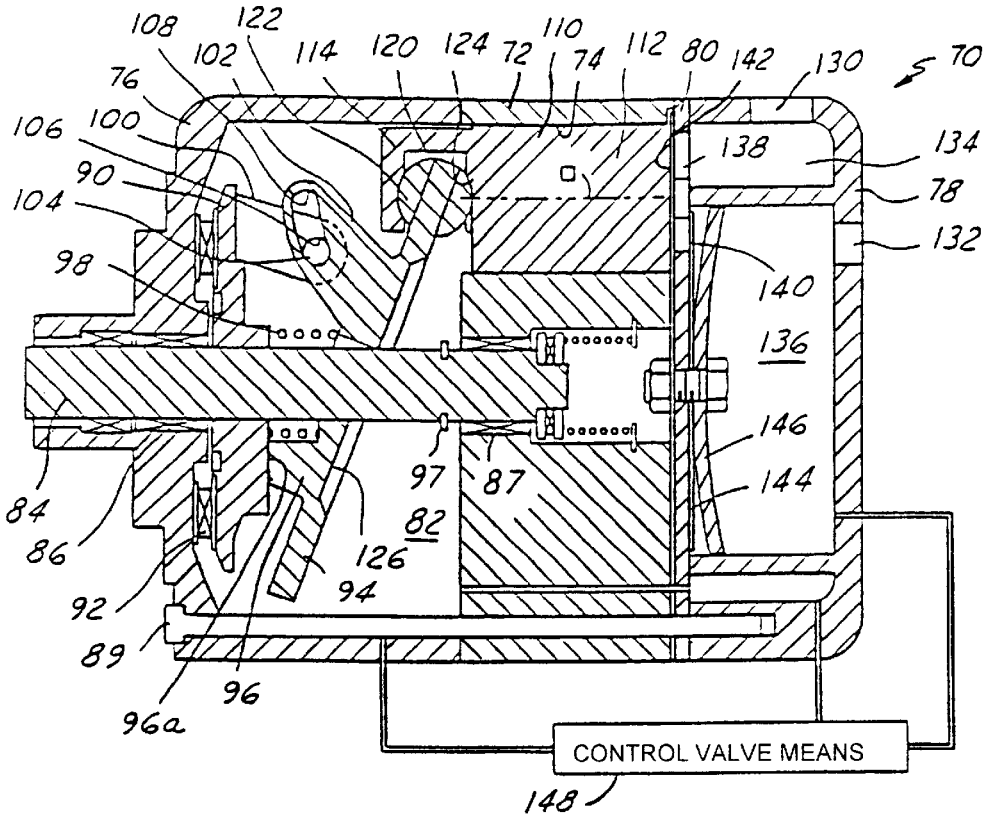
FIG. 3 is a longitudinal cross-sectional view of a variable capacity swash plate type compressor with a piston and a mechanism to minimize a bending moment acting on a piston, in accordance with the present invention.

FIG. 3 shows a compressor, for example, a variable capacity swash plate type compressor, having a mechanism for minimizing a bending moment. The variable capacity swash plate type compressor 70 has a cylinder block 72 provided with a plurality of cylinder bores 74, a front housing 76 and a rear housing 78. Both front and rear ends of the cylinder block 72 are sealingly closed by the front and rear housings 76 and 78, respectively. A valve plate 80 is mounted between the cylinder block 72 and the rear housing 78. The cylinder block 72 and the front housing 76 define a sealed crank chamber 82. A drive shaft 84 is centrally arranged to extend through the front housing 76 to the cylinder block 72, and is rotatably supported by radial bearings 86 and 87. The cylinder block 72 and the front and rear housings 76 and 78 are held together by screws 89.

A rotor 90 is fixedly mounted on the drive shaft 84 within the crank chamber 82 to be rotatable with the drive shaft 84, and supported by a thrust bearing 92 seated on an inner end of the front housing 16. A swash plate 94 is rotatably supported on the drive shaft 84. A spherical sleeve can be mounted between the drive shaft 84 and the swash plate 94, and in this case, the swash plate 94 is rotatably supported on an outer surface of the shaft.

FIG. 3 illustrates the compressor with the swash plate 94 at its maximum inclination angle position. In this position, a spring 98, which biases the swash plate 94 toward its minimum position, is compressed, and a stop surface 96*a* of a projection 96 comes into contact with the rotor 90 so that a further increase of inclination angle of the swash plate 94 is prevented. On the other hand, when the swash plate 94 is in its minimum angle position (not shown), a further decrease of inclination angle of the swash plate 94 is restricted by a stopper 97 provided on the drive shaft 84.

The swash plate 94 is connected to the rotor 90 via a hinge mechanism to be rotated with the rotor 90. That is, a support arm 100 protrudes rearwardly from one side surface of the rotor 90, and an arm 102 protrudes from a front side of the swash plate 94 toward the support arm 100 of the rotor 90. The support arm 100 and the arm 102 overlap each other and are connected to each other by a pin 104. The pin 102 extends into a pin hole 106 formed through the support arm 100 of the rotor 90 and a rectangular shaped hole 108 formed through the arm 102 of the swash plate 94. With this arrangement, the rotor 90 and the swash plate 94 are hinged to each other, and the sliding motion of the pin 104 within the rectangular hole 108 changes an inclination angle of the swash plate 94 so as to change the capacity of the compressor.

Figure 4A:
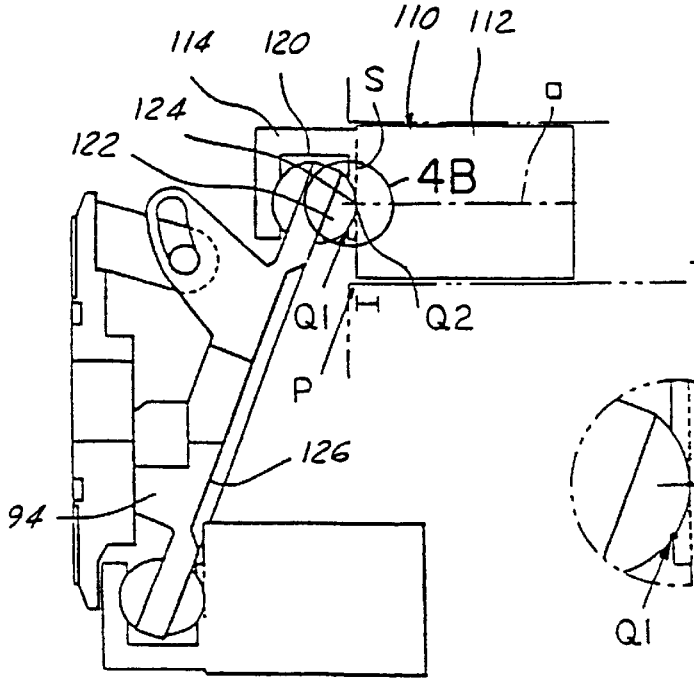
FIG. 4 is an enlarged partial view of FIG. 3 illustrating the configuration of the piston and swash plate.
Figure 4B:
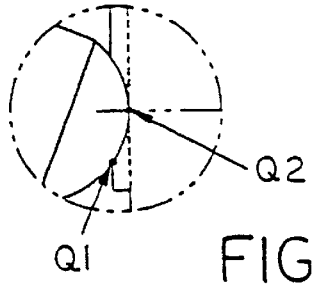

As best illustrated in FIG. 4, each cylindrical piston 110 has a body 112 with a head and a bridge portion 114. The bridge portion 114 has a recess 120, and opposed walls defined in the recess 120 have spherical shoe pockets 124 into which spherical outer surfaces of two semi-spherical shoes 112 are slidably disposed. The inner flat surfaces of the shoes 112 are slidably engaged with side surfaces of the swash plate 94. With this arrangement, each piston 110 is engaged with the swash plate 94 via the shoes 12 and pockets 124, and therefore, the nutating motion of the swash plate 94 causes each piston 110 to reciprocate in the cylinder bore 74.

Figure 1:
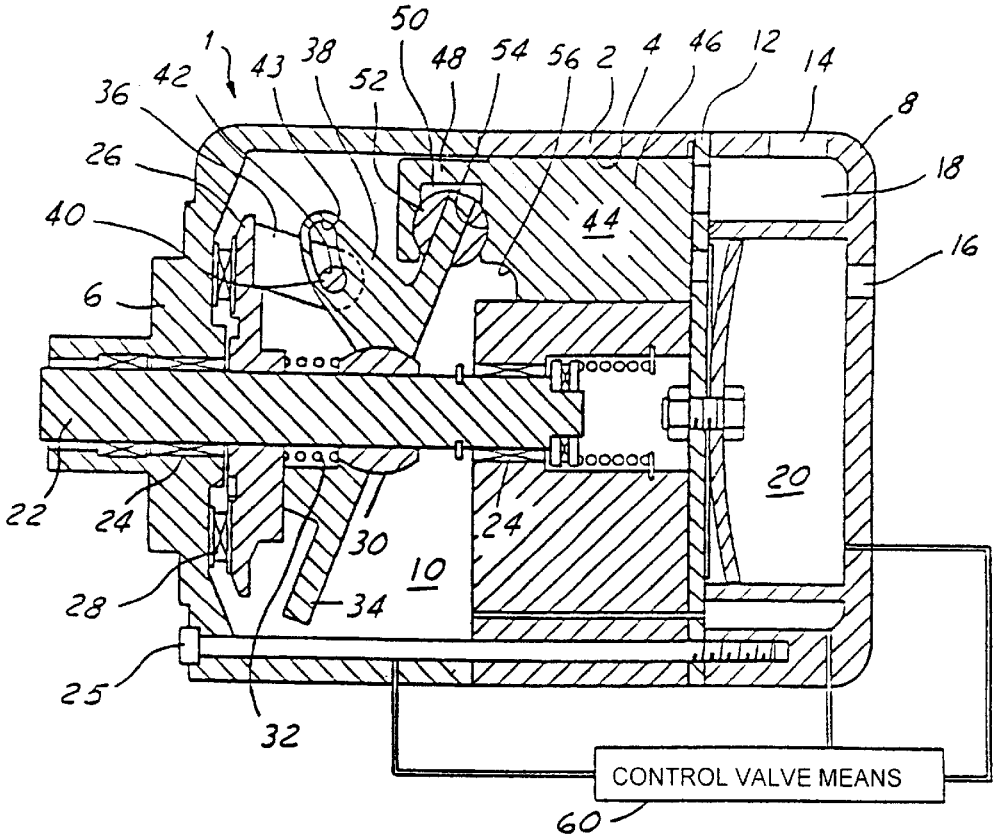
(PRIOR ART) FIG.1
FIG. 1 is a longitudinal cross-sectional view of a swash plate type compressor with a variable displacement mechanism according to the prior art.
Figure 2:
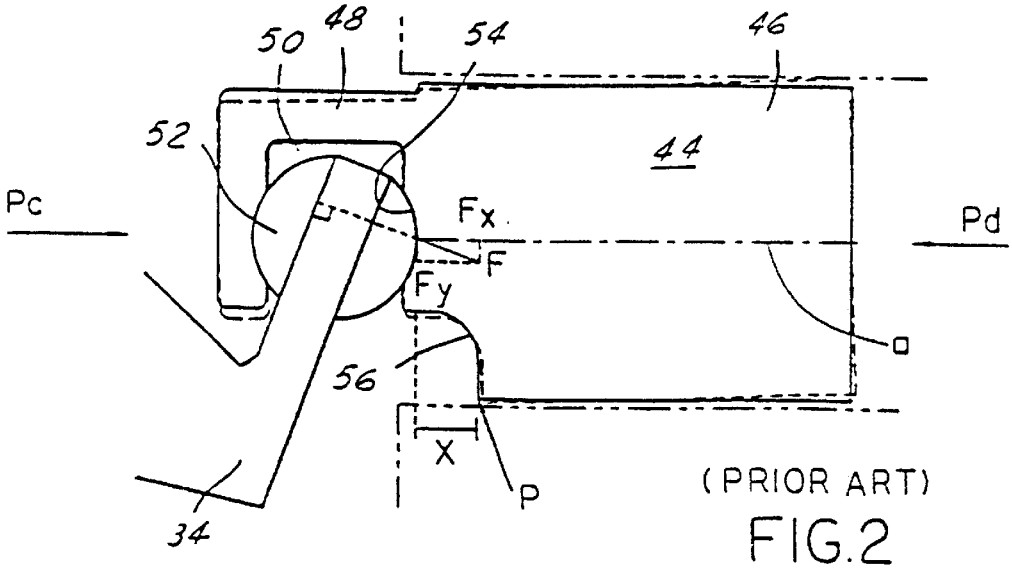
(PRIOR ART) FIG.2
FIG. 2 is an enlarged partial view of FIG. 1 illustrating various forces acting on a piston.

During the compression stroke of the piston 110, the force F (as illustrated in FIG. 2) exerted on the piston 110 from the swash plate 94 via the shoe adjacent to the body 110 of the piston acts on the piston 110 at a right angle to a rear surface of the swash plate 94 at a contact surface (in case of a line contact) or a contact point (in case of a point contact, both will be referred as a contact position or an apex hereinafter) at which the semi-spherical outer surface of the shoe 122 adjacent to the body 112 comes into contact with the semi-spherical inner surface of the shoe pocket 124. The force F exerted from the swash plate 94 on the piston 110 can be considered as two components, the horizontal component $F_x$ lying on the central axis O of the piston 110 and the vertical component $F_y$ perpendicular to the central axis O of the piston 110 (again, as is illustrated in FIG. 2). The vertical component $F_y$ acts on the piston 110 to create a bending moment.

In order to minimize the bending moment, no cutout portion is formed in the body 112 of the piston 110, as is the case with the prior art. That is, in the construction of the piston in accordance with the present invention, the lower edge P of the body 112 of the piston 110 lies on the line S which passes through the apex $Q_2$ of the shoe pocket 124 and is perpendicular to the central axis O of the piston 110. Moreover, the lower edge P of the piston body 112 can be further extended in line with an entrance point $Q_1$ of the shoe pocket 124 near the piston body 112, if so desired. Consequently, the maximum bending moment acting on the piston does not occur as is the case with the prior art, shown in equation (3) above.

The interference between the swash plate 94 and the piston 110 due to the extension of the piston body 112 is avoided by forming a recess 126 in the rear surface of the swash plate 94.

The rear housing 78 is provided with inlet and outlet ports 130 and 132, and divided into suction and discharge chambers 134 and 136. The valve plate 80 has suction and discharge ports 138 and 140. Each cylinder bore 74 communicates with the suction chamber 134 and the discharge chamber 136 via the suction ports 138 and the discharge ports 140, respectively. Each suction port 138 is opened and closed by a suction valve 142, and each discharge port 140 is opened and closed by a discharge valve 144, in response to the reciprocal movement of the respective pistons 110. The opening motion of the discharge valve 144 is restricted by a retainer 146.

A control valve means 148 is provided with the compressor 70 for adjusting a pressure level within the crank chamber 82.

In the compressor having the above-described construction, when the drive shaft 84 is rotated, the swash plate 94, having a certain inclination angle, is also rotated via the hinge mechanism, and thus the nutating motion of the swash plate 94 is converted into the reciprocation of the pistons 110 within the respective cylinder bores 74 via the shoes 122. This reciprocating motion causes the refrigerant gas to be introduced from the suction chamber 134 of the rear housing 78 into the respective cylinder bores 74 in which the refrigerant gas is compressed by the reciprocating motion of the pistons 110. The compressed refrigerant gas is discharged from the respective cylinder bores 74 into the discharge chamber 136.

At this time, the capacity of the compressed refrigerant gas discharged from the cylinder bores 74 into the discharge chamber 136 is controlled by the control valve means 148 which changes the pressure level within the crank chamber 82. Specifically, when the pressure level $P_{sc}$ in the suction chamber 134 is raised, generally as the result of an increase of the thermal load of an evaporator, the control valve means 148 cuts off the refrigerant gas traveling from the discharge chamber 136 into the crank chamber 82 so that the pressure level $P_{cc}$ in the crank chamber 82 is lowered. When the pressure level in the crank chamber 82 is lowered, a back pressure acting on the respective pistons 110 is decreased, and therefore, the angle of inclination of the swash plate 94 is increased. Namely, the pin 104 of the hinge means slides downward within the rectangular hole 108. Accordingly, the swash plate 94 is moved in a forward direction against the force of the spring 98. Therefore, the angle of inclination of the swash plate 94 is increased, and as a result, the stroke of the respective pistons 110 is increased.

On the contrary, when the pressure level $P_{sc}$ in the suction chamber 134 is lowered with decrease of the thermal load of the evaporator, the control valve means 148 passes the compressed refrigerant gas of the discharge chamber 136 into the crank chamber 82. As the pressure level $P_{cc}$ in the crank chamber 82 is raised, a back pressure acting on the respective piston 110 is increased, and therefore, the angle of inclination of the swash plate 94 is decreased. Namely, the pin 104 of the hinge means slides upward within the rectangular hole 108. Accordingly, the swash plate 94 is moved in a reward direction yielding to the force of the spring 98. Therefore, the inclination angle of the swash plate 94 is decreased, and as a result, the stroke of the respective pistons 110 is shortened and the discharge capacity is decreased. Whether at a minimum or maximum inclination angle, or anywhere in between, the recess 126 in the swash plate 94 will allow for piston movement without contact between the point P on the piston 110 and the swash plate 94.

In the above described compressor, during the compression stroke of the piston 110, the pressure $P_{cc}$ in the crank chamber 82 and the compression reaction pressure $P_{dc}$ act on the piston 110. These forces act on the swash plate 94 via the shoes 122 and, in turn, oppositely act on the piston 110 from the swash plate 94 as a reaction force equal in magnitude and oppositely directed. At this time, the maximum bending moment acts on the lower back edge portion P of the piston 110. However, the lower back edge portion P lies on the same line as the vertical component $F_y$ lies, and thus, the bending moment does not occur on the lower back edge portion P of the piston 110 because the distance x is zero. As a result, deformation and abnormal abrasion of the pistons can be prevented.

Although the present invention has been described in connection with the preferred embodiments, the invention is not limited thereto. It will be easily understood by those skilled in the art that variations and modifications can be easily made within the scope of the present invention as defined by the appended claims.

What is claimed is:

1. A single headed piston, adapted for use in a swash plate type of air conditioning compressor including a generally cylindrical block provided with at least one cylinder bore, in which the piston is reciprocally disposed, said piston comprising:

a cylindrical body defining a cylindrical axis;

a bridge portion extending from said body and having a recess and a pair of shoe pockets formed in opposed walls defined in said recess, with each of the shoe pockets including an entrance and an apex; and a lower edge portion of said body positioned at an adjoining portion between said body and said bridge portion, wherein said lower edge portion of said body and said apex lie on a line perpendicular to said central axis of said body.

2. A variable capacity swash plate type compressor comprising:

a housing having a cylindrical block with a plurality of cylinder bores formed therein and enclosing a crank chamber, a suction chamber, and a discharge chamber;

a drive shaft rotatably supported by said housing mechanism;

a plurality of single headed pistons reciprocally disposed in each of said cylinder bores, each of said pistons defining a cylinder having a central axis, a bridge portion extending from said body and having a recess and a pair of shoe pockets formed in opposed walls defined in said recess, with each of the shoe pockets including an entrance and an apex, and a lower edge portion of said body positioned at an adjoining portion between said body and said bridge portion, wherein said lower edge portion of said body and said apex lie on a line perpendicular to said central axis of said body;

a rotor mounted on and rotationally fixed to said drive shaft so as to rotate together with said drive shaft in said crank chamber;

a hinge mechanism operatively engaging said rotor;

a swash plate operatively connected to said rotor via said hinge mechanism and slidably mounted on said drive shaft, said swash plate including a side generally facing said cylinder block, with a recess in said side radially located to be adjacent to the lower edge portion of said piston heads, said recess adapted to avoid interference between said swash plate and said lower edge portions of said pistons.

* * * * *